US010199716B2

(12) United States Patent
Cai et al.

(10) Patent No.: US 10,199,716 B2
(45) Date of Patent: Feb. 5, 2019

(54) ELECTRONIC DEVICE AND ANTENNA OF THE SAME

(71) Applicant: BYD COMPANY LIMITED, Shenzhen, Guangdong (CN)

(72) Inventors: Qinyang Cai, Guangdong (CN); Yijin Wang, Guangdong (CN); Wensong Wang, Guangdong (CN); Munyong Choi, Guangdong (CN)

(73) Assignee: BYD COMPANY LIMITED (CN)

( * ) Notice: Subject to any disclaimer, the term of this patent is extended or adjusted under 35 U.S.C. 154(b) by 50 days.

(21) Appl. No.: 15/313,015

(22) PCT Filed: May 26, 2015

(86) PCT No.: PCT/CN2015/079773

§ 371 (c)(1),
(2) Date: Nov. 21, 2016

(87) PCT Pub. No.: WO2015/180618

PCT Pub. Date: Dec. 3, 2015

(65) Prior Publication Data

US 2017/0149116 A1 May 25, 2017

(30) Foreign Application Priority Data

May 26, 2014 (CN) ..... 2014 2 0273632 U

(51) Int. Cl.
*H01Q 1/22* (2006.01)
*H01Q 13/10* (2006.01)
(Continued)

(52) U.S. Cl.
CPC ..... *H01Q 1/2266* (2013.01); *H01Q 1/42* (2013.01); *H01Q 13/10* (2013.01); *H01Q 1/243* (2013.01); *H01Q 21/30* (2013.01)

(58) Field of Classification Search
CPC ..... H01Q 1/2266; H01Q 13/10; H01Q 1/243; H01Q 21/30
See application file for complete search history.

(56) References Cited

U.S. PATENT DOCUMENTS

2013/0194138 A1 8/2013 Hammond

FOREIGN PATENT DOCUMENTS

CN 102736686 A 10/2012
CN 103579754 A 2/2014
(Continued)

OTHER PUBLICATIONS

International Search Report and Written Opinion from PCT Application No. PCT/CN2015/079773 dated Sep. 2, 2015.

*Primary Examiner* — Dameon E Levi
*Assistant Examiner* — David Lotter
(74) *Attorney, Agent, or Firm* — Calfee, Halter & Griswold LLP

(57) ABSTRACT

An electronic device and an antenna of an electronic device are provided. The electronic device includes a metal shell, and the antenna includes: a radiating surface formed by metal shell and having a slot group penetrated therethrough in an up and down direction of the metal shell, the slot group including a plurality of slots; a medium filling layer including a body part disposed on a lower surface of the metal shell and a plurality of filling parts disposed on an upper surface of the body part and filled in the plurality of slots respectively; and an excitation sheet disposed on a lower surface of the medium filling layer.

10 Claims, 4 Drawing Sheets

(51) Int. Cl.

| | |
|---|---|
| ***H01Q 1/42*** | (2006.01) |
| *H01Q 1/24* | (2006.01) |
| *H01Q 21/30* | (2006.01) |

(56) References Cited

FOREIGN PATENT DOCUMENTS

| | | | |
|---|---|---|---|
| CN | 203950905 | U | 11/2014 |
| EP | 1950834 | A1 | 7/2008 |
| TW | 201405937 | A | 2/2014 |

ELECTRONIC DEVICE AND ANTENNA OF THE SAME

CROSS-REFERENCE TO RELATED APPLICATION

This application is a national phase of International Application No. PCT/CN2015/079773 filed May 26, 2015, which claims priority and benefits of Chinese Patent Application No. 201420273632.0, filed with State Intellectual Property Office, P.R.C. on May 26, 2014, the entire contents of which are incorporated herein by reference.

FIELD

Embodiments of the present disclosure generally relate to an electronic device, and more particularly, to an electronic device and an antenna of an electronic device.

BACKGROUND

Nowadays, an antenna of an electronic device has a radiating surface, and the radiating surface has a double L-shaped slot therein. However, a bandwidth of the conventional antenna is limited, which cannot meet communication requirements of WLAN, 2G, 3G and 4G simultaneously, and the slot has a wide opening, thus affecting an appearance of the electronic device and making it difficult for the electronic to be used in an actual product.

SUMMARY

Embodiments of the present disclosure seek to solve at least one of the problems existing in the related art to at least some extent.

Embodiments of a first aspect of the present disclosure provide an antenna of an electronic device, in which the electronic device includes a metal shell, and the antenna includes: a radiating surface formed by the metal shell and having a slot group penetrated therethrough in an up and down direction of the metal shell, the slot group comprising a plurality of slots; a medium filling layer comprising a body part disposed on a lower surface of the metal shell and a plurality of filling parts disposed on an upper surface of the body part and filled in the plurality of slots respectively; and an excitation sheet disposed on a lower surface of the medium filling layer.

With the antenna of the electronic device according to embodiments of the present disclosure, with the medium filling layer disposed on the lower surface of the metal shell and the filling parts of the medium filling layer filled in the plurality of slots thereof, it is ensured that the appearance of the electronic device cannot be affected by the plurality of slots of the slot group, and thus the antenna can be used in the actual product. In addition, the medium filling layer can bear the excitation sheet, which makes the structure of the antenna more reasonable. Furthermore, by using the metal shell of the electronic device as the radiating surface, a signal of the antenna cannot be shielded, thus improving the use space of the antenna. With the excitation sheet disposed on the lower surface of the metal shell, the performance of the antenna can be improved effectively, and the antenna can cover multiple frequency bands.

In some embodiments, the plurality of slots include first to seventh slots, the first to the third slots are extended in an inner and outer direction of the metal shell and perpendicular to a first edge of the metal shell, outer ends of the second and the third slot are open, each of the fourth to the seventh slots is perpendicular to the second slot; wherein a first end of the fourth slot is connected with an outer end of the first slot and the fourth slot is extended from the outer end of the first slot in a first direction of the metal shell; wherein a first end of the fifth slot is connected with an inner end of the first slot and the fifth slot is extended from the inner end of the first slot in a second direction of the metal shell opposite to the first direction of the metal shell, a second end of the fifth slot is connected with an inner end of the second slot; wherein a first end of the sixth slot is connected with the inner end of the second slot and the sixth slot is extended from the inner end of the second slot in the second direction; wherein a first end of the seventh slot is connected with an inner end of the third slot and the seventh slot is extended from the inner end of the third slot in the first direction, in which, the first direction is one of a right direction and a left direction of metal shell 101, the second direction is the other one of the right direction and the left direction of the metal shell 101.

In some embodiments, the first slot has a width of 0.8 mm to 3 mm and a length of 5 mm to 9 mm, the second slot has a width of 0.8 mm to 3 mm and a length of 6 mm to 10 mm, the third slot has a width of 0.8 mm to 3 mm and a length of 5 mm to 9 mm, the fourth slot has a width of 0.8 mm to 3 mm and a length of 25 mm to 35 mm, the fifth slot has a width of 0.8 mm to 3 mm and a length of 24.5 mm to 34.5 mm, the sixth slot has a width of 0.8 mm to 3 mm and a length of 19 mm to 25 mm, the seventh slot has a width of 0.8 mm to 3 mm and a length of 18 mm to 24 mm.

In some embodiments, a distance between the fourth slot and the first edge of the metal shell in the inner and outer direction is 3 mm to 6 mm, a distance between the fifth slot and the first edge of the metal shell in the inner and outer direction is 4 mm to 9 mm, a distance between the seventh slot and the first edge of the metal shell in the inner and outer direction is 3 mm to 6 mm, a distance between the seventh slot and the sixth slot in the inner and outer direction is 2 mm to 4 mm.

In some embodiments, the seventh slot is disposed between the second slot and the third slot, a distance from the second slot to the seventh slot in the second direction is 3 mm to 7 mm.

In some embodiments, the excitation sheet has an L shape and includes a first limb portion perpendicular to the first slot and a second limb portion perpendicular to the first portion.

In some embodiments, the first limb portion has a length of 20 mm-30 mm and a width of 1 mm to 3 mm, the second portion has a length of 5 mm to 11 mm and a width of 3 mm to 7 mm.

In some embodiments, an inner edge of the first limb portion is in flush with an outer edge of the fourth slot in the inner and outer direction, an outer edge of the second portion is disposed on an outer side of the fourth slot, an inner edge of the second limb portion is disposed on an inner side of the fourth slot, a distance from the second portion to a second end of the fourth slot in the first direction is 9 mm to 15 mm.

In some embodiments, the medium filling layer has a length of 83 mm to 93 mm, a width of 11 mm to 15 mm, and a height of 9 mm to 15 mm.

Embodiments of a second aspect of the present disclosure provide an electronic device including: a metal shell; a display screen disposed on the metal shell; and the antenna according to above embodiments of the present disclosure.

With the electronic device according to embodiments of the present disclosure, with the medium filling layer disposed on the lower surface of the metal shell and the filling parts of the medium filling layer filled in the plurality of slots thereof, it is ensured that the appearance of the electronic device cannot be affected by the plurality of slots of the slot group, and thus the antenna can be used in the actual product. In addition, the medium filling layer can bear the excitation sheet, which makes the structure of the antenna more reasonable. Furthermore, by using the metal shell of the electronic device as the radiating surface, a signal of the antenna cannot be shielded, thus improving the use space of the antenna. With the excitation sheet disposed on the lower surface of the metal shell, the performance of the antenna can be improved effectively, and the antenna can cover multiple frequency bands.

In some embodiments, the electronic device comprises a laptop or a tablet PC.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the accompanying drawings, in which.

DETAILED DESCRIPTION

Figure 1:
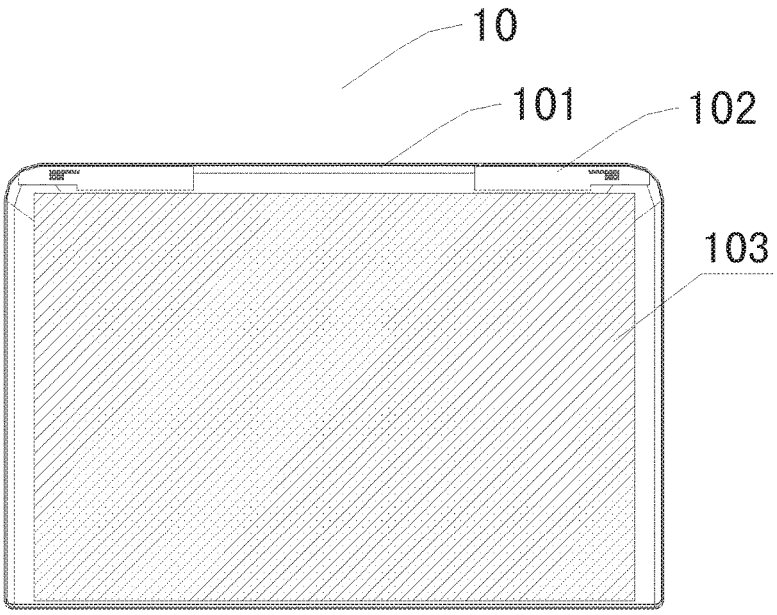
FIG. 1 is a schematic view of an electronic device according to an embodiment of the present disclosure.

Reference will be made in detail to embodiments of the present disclosure. Embodiments of the present disclosure will be shown in drawings, in which the same or similar elements and the elements having same or similar functions are denoted by like reference numerals throughout the descriptions. The embodiments described herein according to drawings are explanatory and illustrative, not construed to limit the present disclosure.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied. Moreover, a structure in which a first feature is "on" a second feature may include an embodiment in which the first feature directly contacts the second feature, and may also include an embodiment in which an additional feature is formed between the first feature and the second feature so that the first feature does not directly contact the second feature.

In the description of the present disclosure, unless specified or limited otherwise, it should be noted that, terms "mounted," "connected" and "coupled" may be understood broadly, such as electronic connections or mechanical connections, inner communications between two elements, direct connections or indirect connections through intervening structures, which can be understood by those skilled in the art according to specific situations.

With reference to the following descriptions and drawings, these and other aspects of embodiments of the present disclosure will become apparent. In the descriptions and drawings, some particular embodiments are described in order to show the principles of embodiments according to the present disclosure, however, it should be appreciated that the scope of embodiments according to the present disclosure is not limited herein. On the contrary, changes, alternatives, and modifications can be made in the embodiments without departing from spirit, principles and scope of the attached claims.

In the following, an electronic device and an antenna of an electronic device will be described in detail with reference to drawings.

FIG. 1 is a schematic view of an electronic device according to an embodiment of the present disclosure. As shown in FIG. 1, the electronic device 10 includes a metal shell 101, a display screen 103 and an antenna 102 having a radiating surface 1021 formed by the metal shell 101. The display screen 103 is disposed on the metal shell 101.

Figure 2:
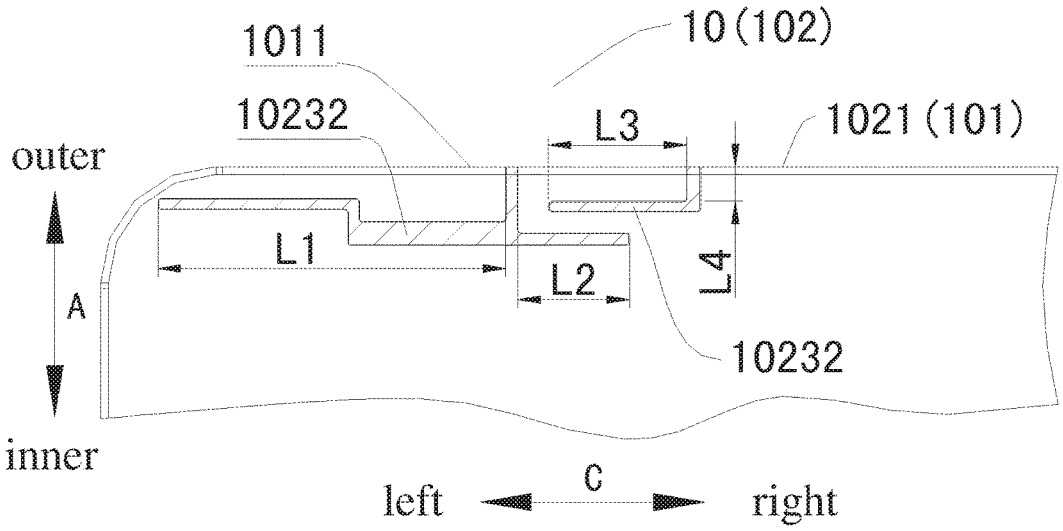
FIG. 2 is a rear view of an antenna of an electronic device according to an embodiment of the present disclosure.
Figure 3:
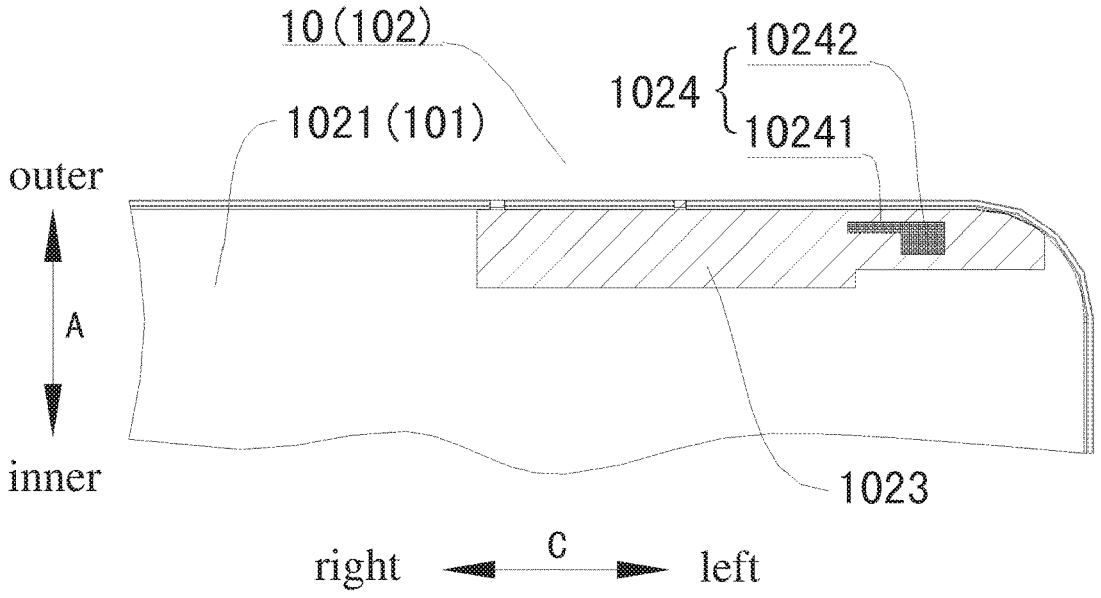
FIG. 3 is a front view of an antenna of an electronic device according to an embodiment of the present disclosure.
Figure 4:
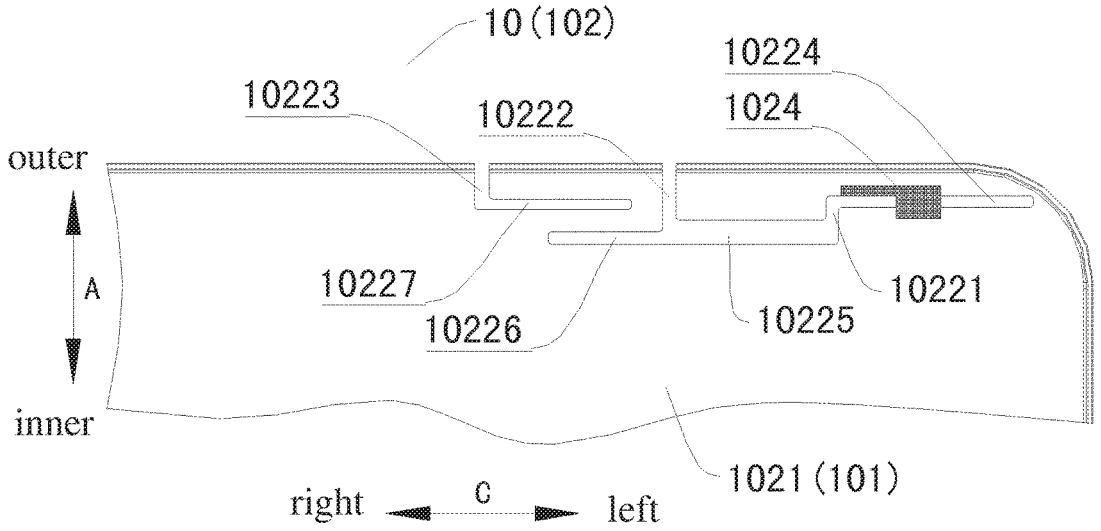
FIG. 4 is a front view of an antenna without a medium filling layer a according to an embodiment of the present disclosure.
Figure 5:
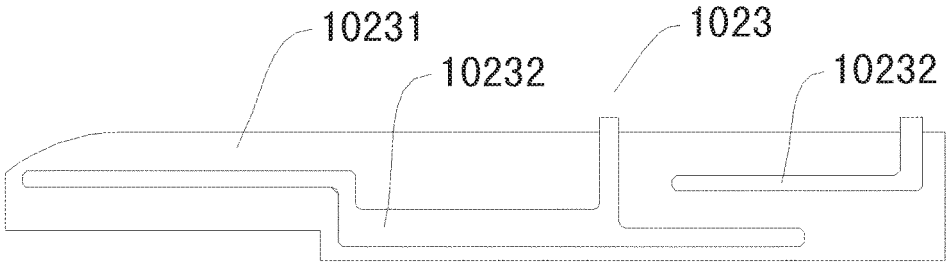
FIG. 5 is a schematic view of a medium filling layer of an antenna according to an embodiment of the present disclosure.

FIG. 2 is a rear view of an antenna of an electronic device according to an embodiment of the present disclosure. FIG. 3 is a front view of an antenna of an electronic device according to an embodiment of the present disclosure. FIG. 4 is a front view of an antenna without a medium filling layer according to an embodiment of the present disclosure. FIG. 5 is a schematic view of a medium filling layer of an antenna according to an embodiment of the present disclosure. As shown in FIGS. 2-5, the antenna 102 of the electronic device 10 includes the radiating surface 1021, a medium filling layer 1023, and an excitation sheet 1024. The radiating surface 1021 is formed by the metal shell 101 and has a slot group penetrated therethrough in an up and down direction of the metal shell 101, and the slot group includes a plurality of slots. The medium filling layer 1023 includes a body part 10231 and a plurality of filling parts 10232, the body part 10231 is disposed on a lower surface of the metal shell 101, and the filling parts 10232 are disposed on an upper surface of the body part 10231 and are filled in the plurality of slots respectively. The excitation sheet 1024 is disposed on a lower surface of the medium filling layer 1023.

With the antenna 102 of the electronic device 10 according to embodiments of the present disclosure, with the medium filling layer 1023 disposed on the lower surface of the metal shell 101 and the filling parts 10232 of the medium filling layer 1023 filled in the plurality of slots thereof, it is ensured that the appearance of the electronic device 10 cannot be affected by the plurality of slots of the slot group, and thus the antenna 102 can be used in the actual product. In addition, the medium filling layer 1023 can bear the excitation sheet 1024, which makes the structure of the antenna 102 more reasonable. Furthermore, by using the metal shell 101 of the electronic device 10 as the radiating surface, a signal of the antenna 102 cannot be shielded, thus improving the use space of the antenna 102. With the excitation sheet 1024 disposed on the lower surface of the metal shell 101, the performance of the antenna 102 can be improved effectively, and the antenna 102 can cover multiple frequency bands.

In an embodiment, the electronic device 10 may be a laptop or a tablet PC. The slot group may be disposed in an outer side of the display screen 103. Furthermore, the slot group may be adjacent to an edge of the metal shell 101, which can make the structure of the electronic device more reasonable.

As shown in FIG. 2 and FIG. 4 (the electronic device 10 shown in FIG. 4 does not include the medium filling layer 1023), the plurality of slots include a first slot 10221, a second slot 10222, a third slot 10223, a fourth slot 10224, a fifth slot 10225, a sixth slot 10226 and a seventh slot 10227, that is, the slot group includes the first slot 10221, the second slot 10222, the third slot 10223, the fourth slot 10224, the fifth slot 10225, the sixth slot 10226 and the seventh slot 10227. The first slot 10221, the second slot 10222 and the third slot 10223 are extended in an inner and outer direction A of the metal shell 101 and are perpendicular to a first edge 1011 of the metal shell 101 respectively, an outer end of the second slot 10222 and an outer end of the third slot 10223 are both open, each of the fourth slot 10224, the fifth slot 10225, the sixth slot 10226 and the seventh slot 10227 is perpendicular to the second slot 10222. The first edge 1011 is an edge of the metal shell 101 at an outside thereof.

A first end of the fourth slot 10224 is connected with an outer end of the first slot 10221 and the fourth slot 10224 is extended from the outer end of the first slot 10221 in a first direction of the metal shell 101. A first end of the fifth slot 10225 is connected with an inner end of the first slot 10221 and the fifth slot 10225 is extended from the inner end of the first slot 10221 in a second direction of the metal shell opposite to the first direction of the metal shell. In other words, the fourth slot 10224 and the fifth slot 10225 may be extended from the outer and inner ends of the first slot 10221 in opposite directions respectively. A first end of the sixth slot is connected with an inner end of the second slot 10222 and the sixth slot 10226 is extended from the inner end of the second slot 10222 in the second direction. A first end of the seventh slot 10227 is connected with an inner end of the third slot 10223 and the seventh slot 10227 is extended from the inner end of the third slot 10223 in the first direction. The first direction is one of a right direction and a left direction of the metal shell 101 in FIGS. 1-5, and the second direction is the other one of the right direction and the left direction of the metal shell in FIGS. 1-5, that is, if the first direction is the right direction, the second direction is the left direction, and if the first direction is the left direction, the second direction is the right direction.

Therefore, the antenna 102 of the electronic device 10 can cover low-frequency bands (704 MHz-960 MHz) and high-frequency bands (1710 MHz-2690 MHz), and thus the electronic device 10 with the antenna 102 can meet communication requirements of WLAN, 2G, 3G and 4G simultaneously.

Specifically, the fourth slot 10224, the first slot 10221 and the fifth slot 10225 form a first resonant branch L1, the first resonant branch L1 generates a first resonance point, and the first resonance point covers the low-frequency resonance bands (704 MHz-960 MHz). The sixth slot 10226 forms a second resonant branch L2, and the second resonant branch L2 generates a second resonance point. The seventh slot 10227 forms a third resonant branch L3, the third slot 10223 form a fourth resonant branch L4, and the third resonant branch L3 and the fourth resonant branch L4 generate the third resonant point. The second resonance point and the third resonance point cover the high-frequency bands (1710 MHz-2690 MHz) together.

In an embodiment, the first slot 10221 has a width of 0.8 mm to 3 mm and a length of 5 mm to 9 mm. The second slot 10222 has a width of 0.8 mm to 3 mm and a length of 6 mm to 10 mm. The third slot 10223 has a width of 0.8 mm to 3 mm and a length of 5 mm to 9 mm. The fourth slot 10224 has a width of 0.8 mm to 3 mm and a length of 25 mm to 35 mm. The fifth slot 10225 has a width of 0.8 mm to 3 mm and a length of 24.5 mm to 34.5 mm. The sixth slot 10226 has a width of 0.8 mm to 3 mm and a length of 19 mm to 25 mm. The seventh slot 10227 has a width of 0.8 mm to 3 mm and a length of 18 mm to 24 mm. Thus, the structure of the antenna 102 can be more reasonable.

Furthermore, the width of the first slot 10221 is 1.5 mm and the length of the first slot 10221 is 7 mm. The width of the second slot 10222 is 1.5 mm and the length of the second slot 10222 is 8 mm. The width of the third slot 10223 is 2 mm and the length of the third slot 10223 is 7 mm. The width of the fourth slot 10224 is 1.5 mm and the length of the fourth slot 10224 is 30 mm. The width of the fifth slot 10225 is 3.8 mm and the length of the fifth slot 10225 is 29.5 mm. The width of the sixth slot 10226 is 1.5 mm and the length of the sixth slot 10226 is 22 mm. The width of the seventh slot 10227 is 1.5 mm and the length of the seventh slot 10227 is 21 mm. Thus, the structure of the antenna 102 can be more reasonable.

In an embodiment of the present disclosure, a distance between the fourth slot 10224 and the first edge 1011 of the metal shell 101 in the inner and outer direction A is 3 mm to 6 mm, a distance between the fifth slot 10225 and the first edge 1011 of the metal shell 101 in the inner and outer direction A is 4 mm to 9 mm, a distance between the seventh slot 10227 and the first edge 1011 of the metal shell 101 in the inner and outer direction A is 3 mm to 6 mm, a distance between the seventh slot 10227 and the sixth slot 10226 in the inner and outer direction A is 2 mm to 4 mm, such that the structure of the antenna 102 can be more reasonable.

Furthermore, the distance between the fourth slot 10224 and the first edge 1011 of the metal shell 101 in the inner and outer direction A is 4.5 mm, the distance between the fifth slot 10225 and the first edge 1011 of the metal shell 101 in the inner and outer direction A is 8 mm, the distance between the seventh slot 10227 and the first edge 1011 of the metal shell 101 in the inner and outer direction A is 5 mm, the distance between the seventh slot 10227 and the sixth slot 10226 in the inner and outer direction A is 3.5 mm, such that the structure of the antenna 102 can be more reasonable.

Figure 6:
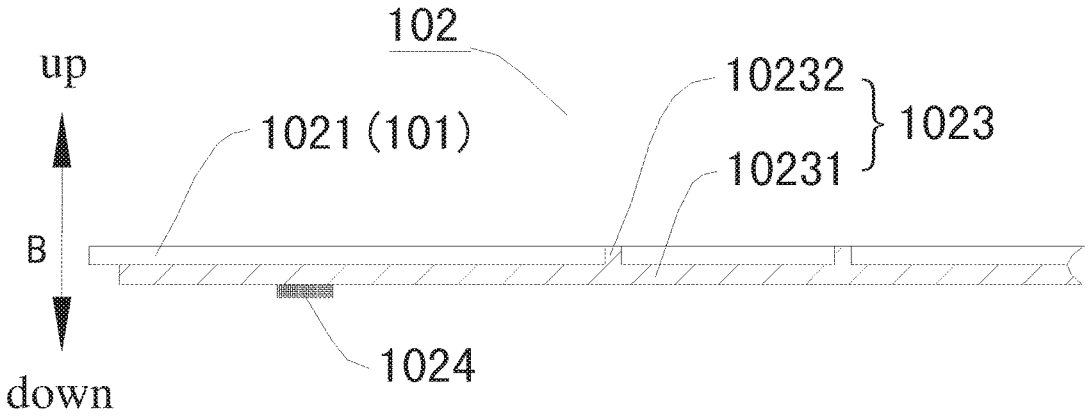
FIG. 6 is a cross-sectional view of an antenna of an electronic device according to an embodiment of the present disclosure.

FIG. 6 is a cross-sectional view of an antenna of an electronic device according to an embodiment of the present disclosure. Specifically, a direction oriented from outside to a center of the electronic device 10 is inward, and a direction oriented from the center of the electronic device 10 to outside is outward, the inner and outer direction A is shown in FIGS. 1-4, and the up and down direction B is shown in FIG. 6. The first edge 1011 of the metal shell 101 may be a front edge of the metal shell 101, and the first edge 1011 of the metal shell 101 may be a left side edge or a right side edge of the metal shell 101. The first direction may be the left direction, the second direction may be the right direction, and a left and right direction C is shown in FIGS. 1-4.

In an embodiment of the present disclosure as shown in FIG. 4, the seventh slot 10227 is disposed between the second slot 10222 and the third slot 10223, a distance from the second slot 10222 to the seventh slot 10227 in the second direction is 3 mm to 7 mm, and thus the structure of the antenna 102 can be more reasonable. Furthermore, the seventh slot 10227 is disposed between the second slot 10222 and the third slot 10223 in the left and right direction C.

In an embodiment of the present disclosure, the medium filling layer 1023 has a length of 83 to 93 mm, a width of 11 mm to 15 mm and a height of 0.5 mm to 1 mm. The medium filling layer 1023 is formed by the material with a dielectric constant of 1-3.

Furthermore, the length of the medium filling layer 1023 is 88 mm, the width of the medium filling layer 1023 is 13 mm, and the height of the medium filling layer 1023 is 0.5 mm. The medium filling layer 1023 is formed by the material with a dielectric constant of 3.

As shown in FIG. 3 and FIG. 4, the excitation sheet has L shape. In other words, the excitation sheet 1024 includes a first limb portion 10241 and a second limb portion 10242, and the first limb portion 10241 is perpendicular to the second portion 10242. The first limb portion 10241 is perpendicular to the first slot 10221, the second portion 10242 is disposed on the fourth slot 10224, and the second portion 10241 is disposed on the fourth slot 10224. The first limb portion 10241 has a length of 20 mm-30 mm and a width of 1 mm to 3 mm. The second limb portion 10242 has a length of 5 mm to 11 mm and a width of 3 mm to 7 mm. Thus, the structure of the antenna 102 can be more reasonable.

Furthermore, the length of the first limb portion 10241 is 25 mm and the width of the first limb portion 10241 is 2 mm. The length of the second limb portion 10242 is 8 mm and the width of the second limb portion 10242 is 5 mm. Thus, the structure of the antenna 102 can be more reasonable.

Figure 7:
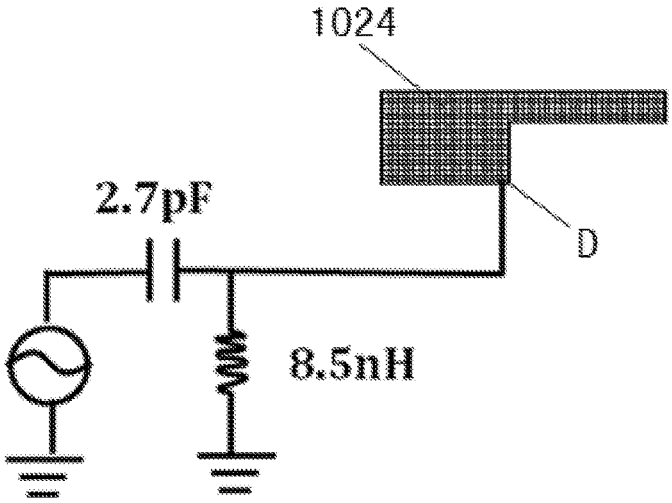
FIG. 7 is a schematic view of an antenna matching network according to an embodiment of the present disclosure.

FIG. 7 is a schematic view of an antenna matching network according to an embodiment of the present disclosure. As shown in FIG. 7, node D is an access point of a feeder line after the feeder line is connected with the matching network, and the access point of the feeder cable may affect a bandwidth of the antenna 102, and the matching network is used to optimize a performance of the frequency band of 704 MHz-960 MHz.

In an embodiment of the present disclosure, an inner edge of the first limb portion 10241 of the excitation sheet 1024 is in flush with an outer edge of the fourth slot 10224 in the inner and outer direction A, an outer edge of the second limb portion 10242 of the excitation sheet 1024 is disposed on an outer side of the fourth slot 10224, an inner edge of the second limb portion 10242 is disposed on an inner side of the fourth slot 10224, a distance from the second limb portion 10242 to a second end (i.e., an end of the fourth slot 10224 away from the first slot 10221) of the fourth slot 10224 in the first direction is 9 mm to 15 mm, such that the structure of the antenna 102 can be more reasonable.

Figure 8:
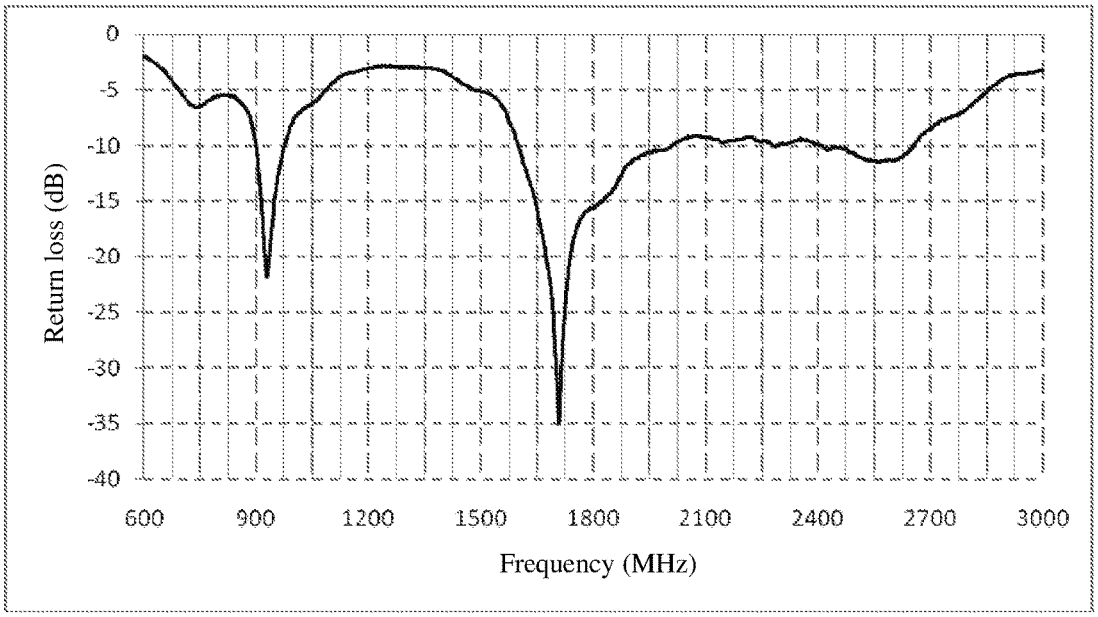
FIG. 8 is a schematic view of frequency bands of an antenna according to an embodiment of the present disclosure.

FIG. 8 is a schematic view of frequency bands of an antenna according to an embodiment of the present disclosure. As shown in FIG. 8, the antenna 102 of the electronic device 10 covers the low-frequency bands (704 MHz-960 MHz) and high-frequency bands (1710 MHz-2690 MHz).

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. An antenna of an electronic device, the electronic device comprising a metal shell, the antenna comprising:

a radiating surface formed by the metal shell and having a slot group penetrated therethrough in an up and down direction of the metal shell, the slot group comprising a plurality of slots;

an integrally formed medium filling layer comprising a body part disposed on a lower surface of the metal shell and a plurality of filling parts disposed on an upper surface of the body part and filled in the plurality of slots respectively; and an excitation sheet disposed on a lower surface of the medium filling layer, wherein the plurality of slots comprise a first to seventh slots, the first to the third slots are extended in an inner and outer direction of the metal shell and are perpendicular to a first edge of the metal shell, outer ends of both the second and the third slot are open, each of the fourth to the seventh slots is perpendicular to the second slot;

wherein a first end of the fourth slot is connected with an outer end of the first slot and the fourth slot is extended from the outer end of the first slot in a first direction of the metal shell;

wherein a first end of the fifth slot is connected with an inner end of the first slot and the fifth slot is extended from the inner end of the first slot in a second direction of the metal shell opposite to the first direction of the metal shell, a second end of the fifth slot is connected with an inner end of the second slot;

wherein a first end of the sixth slot is connected with the inner end of the second slot and the sixth slot is extended from the inner end of the second slot in the second direction of the metal shell;

wherein a first end of the seventh slot is connected with an inner end of the third slot and the seventh slot is extended from the inner end of the third slot in the first direction of the metal shell, wherein the first direction is one of a right direction and a left direction of the metal shell, the second direction is the other one of the right direction and the left direction of the metal shell.

2. The antenna of claim 1, wherein the first slot has a width of 0.8 mm to 3 mm and a length of 5 mm to 9 mm, the second slot has a width of 0.8 mm to 3 mm and a length of 6 mm to 10 mm, the third slot has a width of 0.8 mm to 3 mm and a length of 5 mm to 9 mm, the fourth slot has a width of 0.8 mm to 3 mm and a length of 25 mm to 35 mm, the fifth slot has a width of 0.8 mm to 3 mm and a length of 24.5 mm to 34.5 mm, the sixth slot has a width of 0.8 mm to 3 mm and a length of 19 mm to 25 mm, the seventh slot has a width of 0.8 mm to 3 mm and a length of 18 mm to 24 mm.

3. The antenna of claim 1, wherein a distance between the fourth slot and the first edge of the metal shell in the inner and outer direction is 3 mm to 6 mm, a distance between the fifth slot and the first edge of the metal shell in the inner and outer direction is 4 mm to 9 mm, a distance between the seventh slot and the first edge of the metal shell in the inner and outer direction is 3 mm to 6 mm, a distance between the seventh slot and the sixth slot in the inner and outer direction is 2 mm to 4 mm.

4. The antenna of claim 1, wherein the seventh slot is disposed between the second slot and the third slot, a distance between the second slot and the seventh slot in the second direction of the metal shell is 3 mm to 7 mm.

5. The antenna of claim 1, wherein the excitation sheet has an L shape and comprises a first limb portion perpendicular to the first slot and a second limb portion perpendicular to the first portion.

6. The antenna of claim 5, wherein the first limb portion has a length of 20 mm-30 mm and a width of 1 mm to 3 mm, the second portion has a length of 5 mm to 11 mm and a width of 3 mm to 7 mm.

7. The antenna of claim 5, wherein an inner edge of the first limb portion is in flush with an outer edge of the fourth slot in the inner and outer direction, an outer edge of the second portion is disposed on an outer side of the fourth slot, an inner edge of the second limb portion is disposed on an inner side of the fourth slot, a distance between the second portion and a second end of the fourth slot in the first direction of the metal shell is 9 mm to 15 mm.

8. The antenna of claim 1, wherein the medium filling layer has a length of 83 mm to 93 mm, a width of 11 mm to 15 mm, and a height of 9 mm to 15 mm.

9. An electronic device, comprising:

a metal shell;

a display screen disposed on the metal shell; and an antenna according to claim 1.

10. The electronic device of claim 9, wherein the electronic device comprises a laptop or a tablet PC.

* * * * *